US006490891B1

(12) United States Patent
Stringer et al.

(10) Patent No.: US 6,490,891 B1
(45) Date of Patent: Dec. 10, 2002

(54) DRAW BOLT ASSEMBLIES

(76) Inventors: Robert W. Stringer, Birch Hall, Cockfield Road, Feisham, Bury St. Edmunds, Suffolk (GB), IP30 0QP; Eric Lai, Hung Wai Industrial Center, Block A 1 16/F Pui To Road, Tuen Mun, New Territories, Hong Kong (CN)

( * ) Notice: Subject to any disclaimer, the term of this patent is extended or adjusted under 35 U.S.C. 154(b) by 0 days.

(21) Appl. No.: 09/486,841

(22) PCT Filed: Sep. 3, 1998

(86) PCT No.: PCT/GB98/02641

§ 371 (c)(1),
(2), (4) Date: May 1, 2000

(87) PCT Pub. No.: WO99/11891

PCT Pub. Date: Mar. 11, 1999

(30) Foreign Application Priority Data

Sep. 3, 1997 (GB) ..... 9718714
Oct. 30, 1997 (GB) ..... 9722955

(51) Int. Cl.[7] ..... E05B 37/08
(52) U.S. Cl. ..... 70/23; 70/316
(58) Field of Search ..... 70/23, 25, 26, 70/312, 316–318

(56) References Cited

U.S. PATENT DOCUMENTS 1,966,334 A * 7/1934 Cruse
4,938,044 A * 7/1990 Chang

* cited by examiner

*Primary Examiner*—William A. Cuchlinski, Jr.
*Assistant Examiner*—Edward Pipala
(74) *Attorney, Agent, or Firm*—McAndrews, Held & Malloy, Ltd.

(57) ABSTRACT

Draw bolt having a housing (14, 50, 70) including a passageway (32) within which a bolt (24, 46, 72) is slidably mounted. A plurality of annuli (18, 54, 78), each of which has an internal slot (40, 58), are aligned in the passageway (32) and are restrained from axial movement. Each annuli (18, 54, 78) has a plurality of symbols on an external surface to indicate the position of the slot (40, 58). The alignment of the slot (40, 58) and symbols is adjustable by relative movement of a body (36, 56, 90) including the slot (40, 58) and an element (34, 60, 88) bearing the symbols. The bolt (24, 46, 72) includes at least one radially extending spigot (26, 86). Movement of the bolt (24, 46, 72) along the passageway (32) is possible only when the or each spigot (26, 86) is aligned with the slots (40, 58) of the annuli (18, 54, 78).

17 Claims, 8 Drawing Sheets

DRAW BOLT ASSEMBLIES

This invention relates to draw bolts and in particular to such bolts adapted to be locked.

Draw bolt assemblies of the kind to which the invention relates are typically used to lock lorry cargo doors, building doors and in particular external doors or gates. They can also be used to lock windows, vents or cat flaps. Draw bolt assemblies such as those used on external doors and gates generally comprise a housing having a bolt slidably mounted therein, the housing being attached to a surface of the door or gate adjacent the edge which lies opposite the hinge. A receiving member is generally disposed on a door jamb or gate post in such a location that when the door or gate is closed the bolt may be slid along a longitudinal axis of the housing to locate in the receiving member. With such a known system anyone who has access to the draw bolt may lock or unlock the door or gate.

In the past a secure way of locking a draw bolt has been to use a padlock in conjunction with the bolt assembly. However, this can be expensive, and a key is normally required. Additionally, to lock and unlock a padlock is time consuming. This situation can occur for example when a lorry driver is unloading goods and must make several trips, each time leaving the lorry unattended and therefore having to secure the cargo doors each time he is away from the lorry.

The present invention is directed at draw bolt assemblies which are capable of fulfilling broadly the same objectives as those of the prior systems discussed above, but which are capable of being securely locked, and are easier and quicker to use. According to the invention a draw bolt assembly comprises a housing having a passageway formed therein; a bolt slidably mounted in the passageway; and a plurality of annuli aligned in the passageway, each annulus having an internal slot and being restrained by the housing from axial movement relative thereto, the bolt having at least one, and normally a plurality of spigots extending radially therefrom, the spigot or spigots being axially aligned whereby rotation of the annuli to axially align the slots therewith allows movement of the bolt along the passage. Each annulus comprises a body formed with the internal slot and an element bearing a plurality of symbols to be visible on an external surface thereof to indicate the position of the slot in the annulus, the relative orientation of the body and element being adjustable to change the alignment of the slot relative to the symbols. In this way provision is made for altering the sequence of visible symbols that must be established to release the bolt. In other words, the invention provides for a draw bolt assembly to be coded or programmed by the user to require a selected sequence to release the bolt, notwithstanding the sequence installed at the point of manufacture. In some embodiments the housing is attached to a surface using attachment means which are protected from tampering by the annuli and/or the installed bolt.

In preferred embodiments of the invention the body and element of each annulus are themselves annuli in axially abutting engagement, with a locking mechanism setting their relative angular orientation. Typically, the locking mechanism comprises pins extending axially from one of the body and element, and received in at least two of a greater plurality of sockets formed in the other of the body and element. In such an arrangement, the assembly can be dismantled by totally removing the bolt to free the annuli for withdrawal from the housing. The body and element of one or more of the annuli can then be separated, re-oriented and re-coupled, and the annuli then replaced in the housing in a chosen order, which may not be the same as that followed previously, before re-fitting the bolt and completing the re-assembly.

Provision may be made for the re-orientation of the annuli to be accomplished without dismantling the assembly. In other words, it may be made possible to re-code the assembly in situ. More significantly, it enables a purchaser to fit the assembly, and then set a chosen code. A means by which this can be accomplished involves coupling the slotted bodies of the annuli for simultaneous axial movement relative to the symbol-bearing elements. A re-coding key fitted to the assembly can be activated to effect this axial movement of the slotted bodies, normally against some form of resilient mechanism such as a spring. With the bodies and the elements of the annuli disengaged by this movement, they can be relatively re-oriented before being re-engaged with a different selected code or symbol sequence. Such re-coding should only be available to a party knowing the previous code, and thus is preferably only possible while the slots of the annuli are aligned with the spigot or spigots. This is conveniently accomplished by linking or attaching the key to the bolt, and effecting the relative movement of the slotted bodies of the annuli by movement of the bolt beyond its normal locked or unlocked position. A stop mechanism can be provided for normally preventing such abnormal movement of the bolt, but if such movement is possible in any event only when the currently effective code is in place, the mechanism can be no more than a simple screw arrangement, operable without restriction.

The draw bolt assembly of the present invention restricts the movement of the bolt in the housing to movement by a user who knows the selected sequence of symbols that aligns the slots. Assemblies according to the invention are therefore quick and easy to use without the need for a key. Further, the invention allows the selected sequence to be changed easily, for added security.

The bolt of the present invention may also be used as a lockable latch. In this case, a latch member is connected to and biased axially away from the bolt. When the bolt is unlocked, the latch member can move into the housing of the bolt to allow the latch to open and close, but when the bolt is locked, the latch is restrained.

Embodiments of the invention will now be described by way of example and with reference to the accompanying schematic drawings wherein.

Figure 11A:
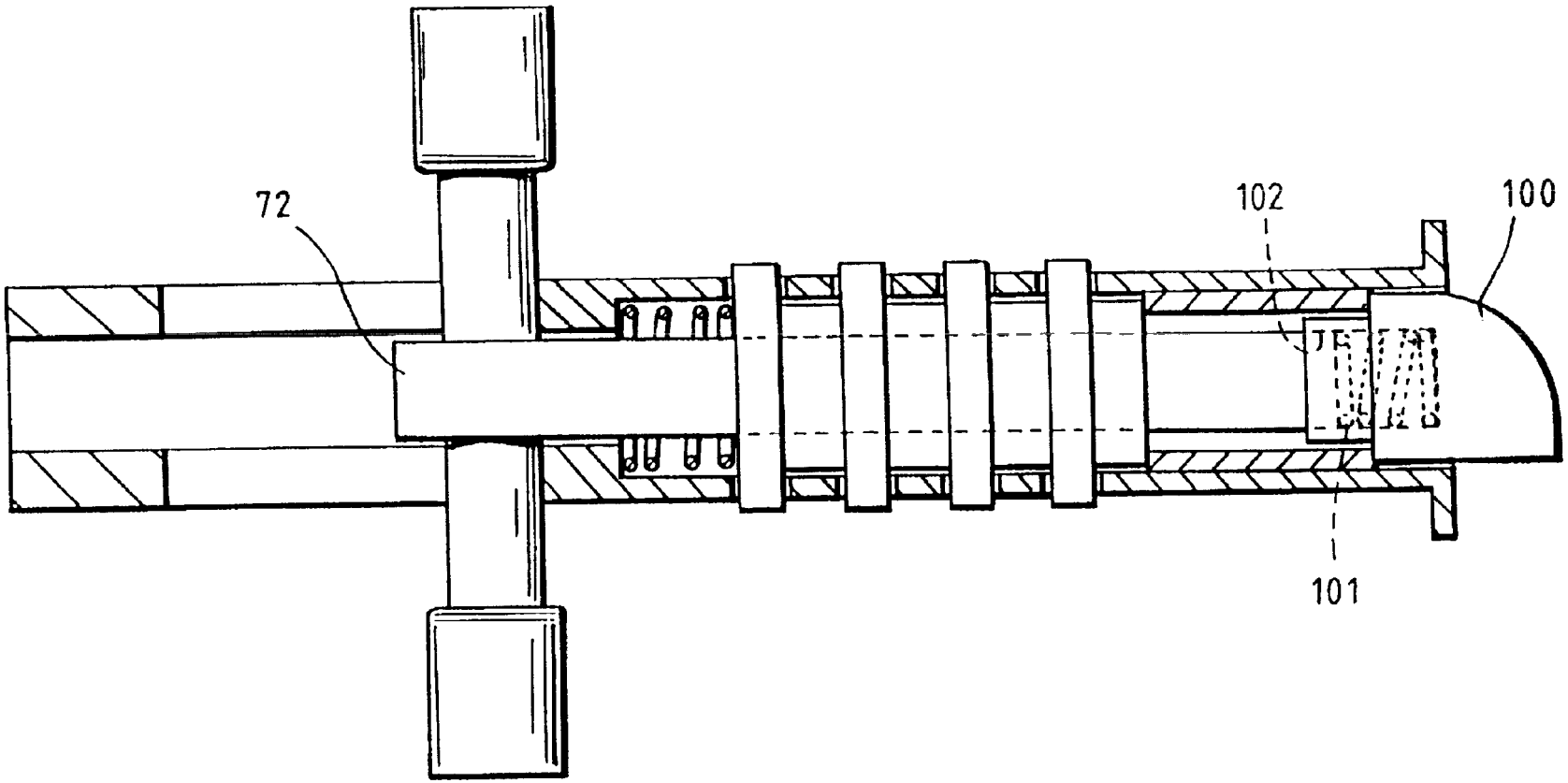
Figure 11B:
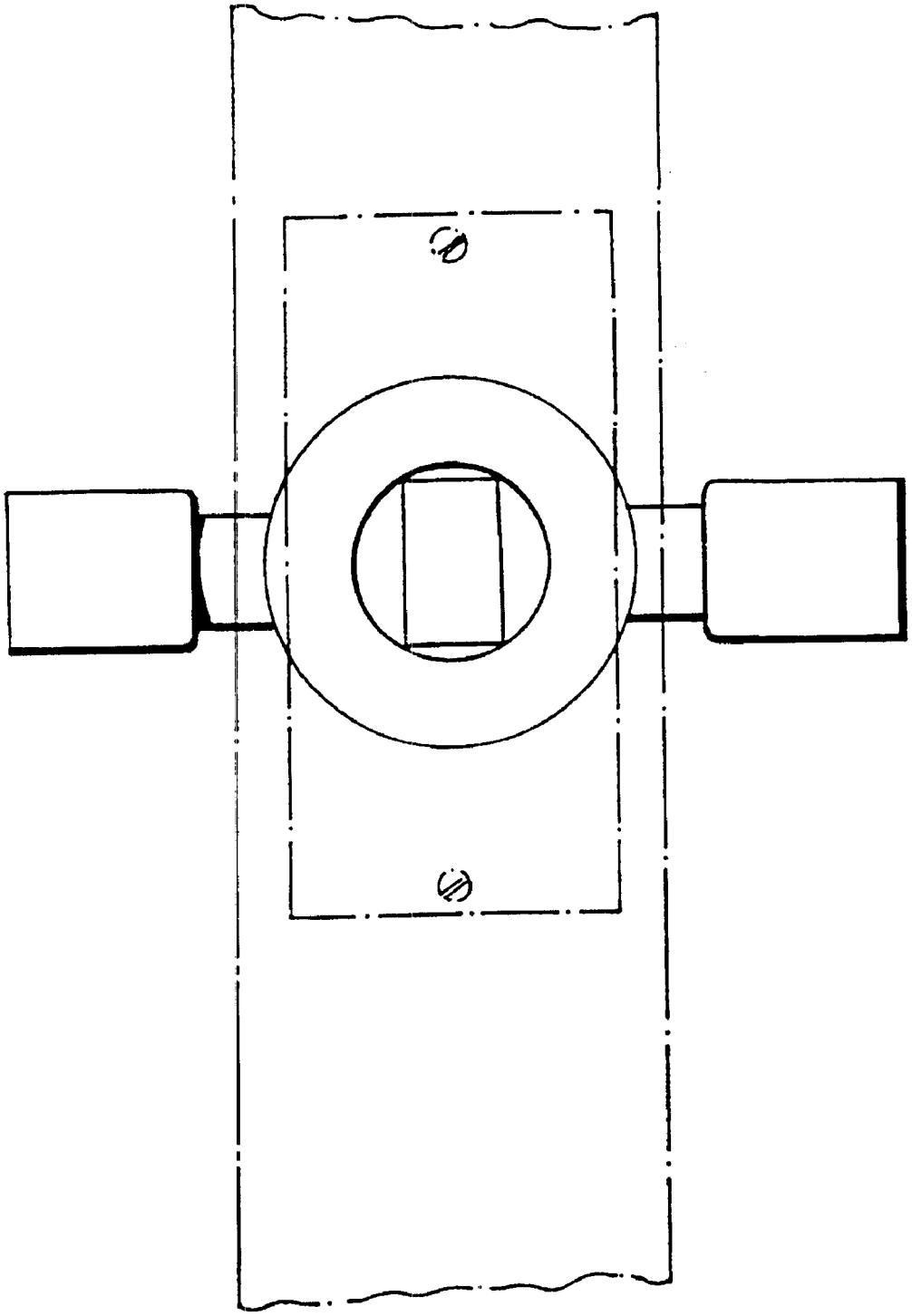

FIGS. 11*a* and 11*b* illustrate a lockable latch including a draw bolt according to the present invention.

Figure 1:
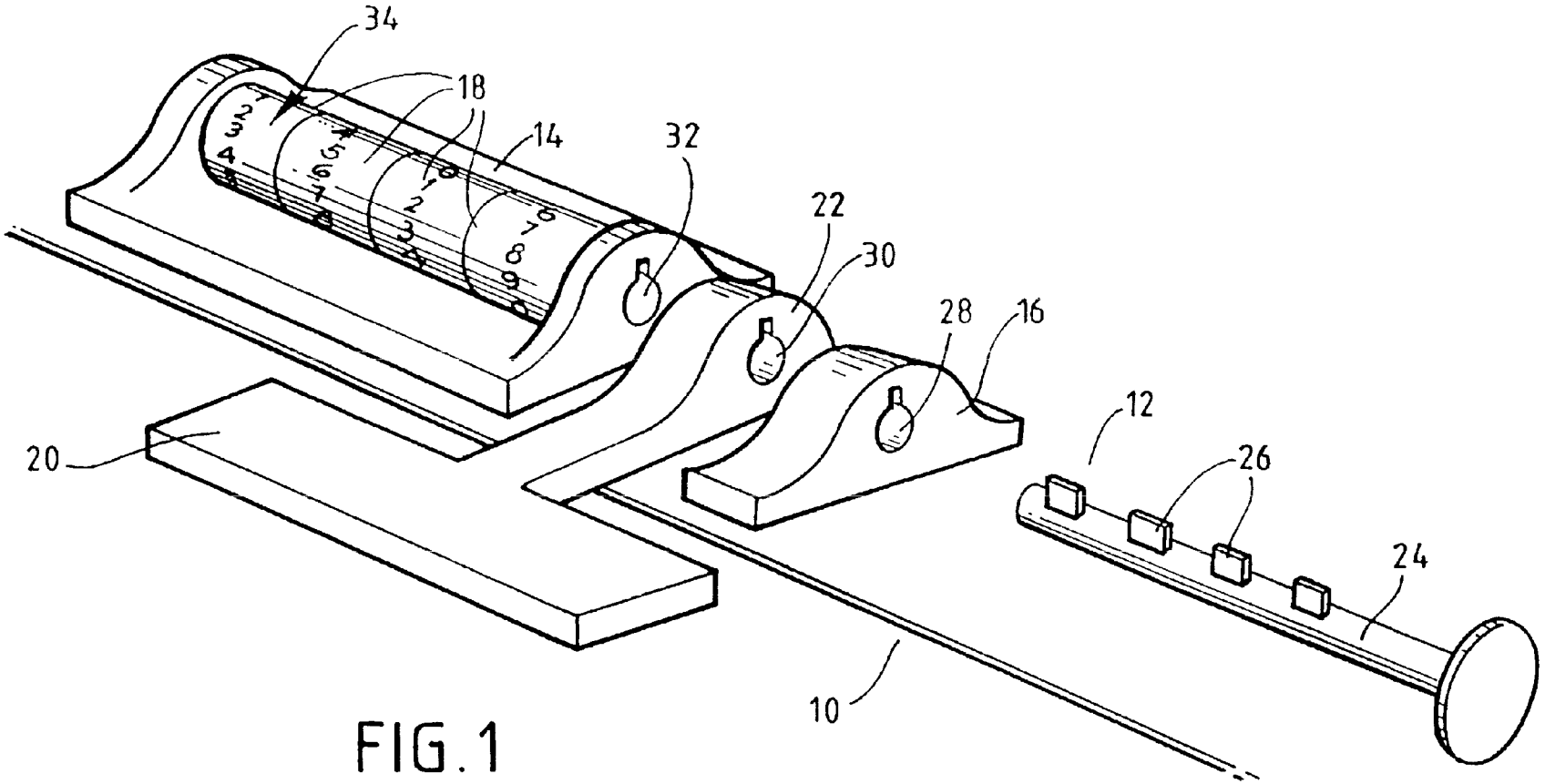
FIG. 1 is a perspective view of a draw bolt assembly according to a first embodiment of the invention.

FIG. 1 illustrates a draw bolt assembly fitted to a door 10 and a fixed surface 12. The housing 14 and the alignment member 16 are attached to the fixed surface 12 by attachment means (not shown). The housing has four annuli 18 disposed thereon in axial alignment as can he seen in FIG. 1. A keep plate 20 having a keep member 22 is disposed on the door 10 so that the keep member 22 locates between the housing 14 and the locating section 16 when the door 10 is shut as shown in FIG. 1. The door can be locked by sliding a bolt 24 having spigots 26 extending radially therefrom through the passageway 28 formed in the locating member and the passageway 30 formed in the keep member into the passageway 32 formed in the housing 14 and annuli 18. The bolt 24 can only be slid in or out of the passageway 32 once each annuli 18 has been rotated to an "open" position. The "open" position is defined when slots within the annuli are in alignment with the spigots of the bolt.

Figure 2:
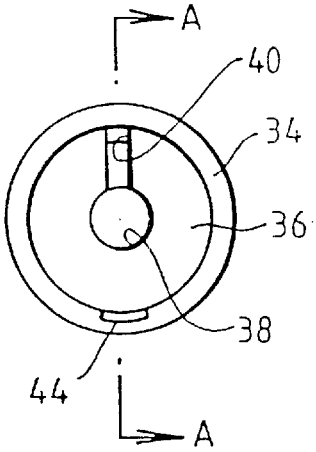
FIG. 2 is an end view of one of the annuli of FIG. 1.
Figure 3:
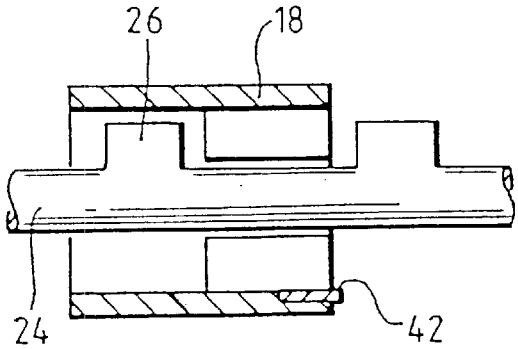
FIG. 3 is a sectional view of the annulus of FIG. 2 taken along line AA and showing a section of bolt therein.

An annulus 18 is shown in more detail in FIGS. 2 and 3. The annulus is formed as two pieces. The annulus shown in FIG. 2 has an external element 34 with a body 36 fitted within it. The body 36 has a passageway 38 and slot 40 which extend its entire length. The passageway 38 and the slot 40 are large enough to allow the bolt 24. and a spigot 26 to slide therethrough when the spigot and slot are aligned. The body 36 extends along only a part of the length of the element 34. The bolt 24 can only be inserted through the annulus 18 when the slot 40 is in the correct alignment. Once the bolt 24 with spigot 26 has reached the position shown in FIG. 3, the annulus 18 may be rotated so that the slot 40 and the spigot 26 are rotationally misaligned. It will be noted that the bolt 24 can also be rotated. However, bolt 24 cannot move axially within the passageway 38. Each annulus 18 has a symbol visible on its curved external surface as shown in FIG. 1.

Each annulus 18 in the assembly of FIG. 1 has a series of numbers depicted on the outer cylindrical surface of the respective element 34. One of these numbers will be aligned with the slot 40, so that a unique "release" sequence of aligned numbers will enable the bolt 24 to be received in or withdrawn from the passage 38. However, by rotating the body 36 within the element 34 the number aligned with the slot will be altered, thereby enabling the "release" sequence to be altered. In order to set each annulus 18 to a particular number a selectively removable wedge 42 is fitted in a slot 44 in the element 34.

Figure 4:
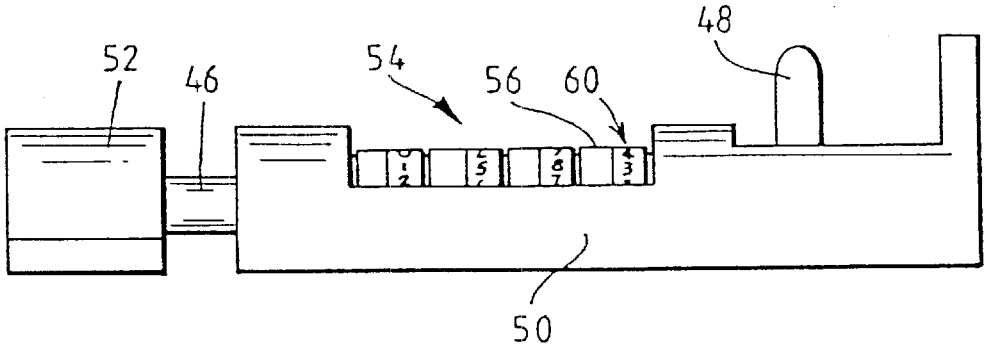
FIG. 4 is a side view of a draw bolt assembly according to a second embodiment of the invention.
Figure 5:
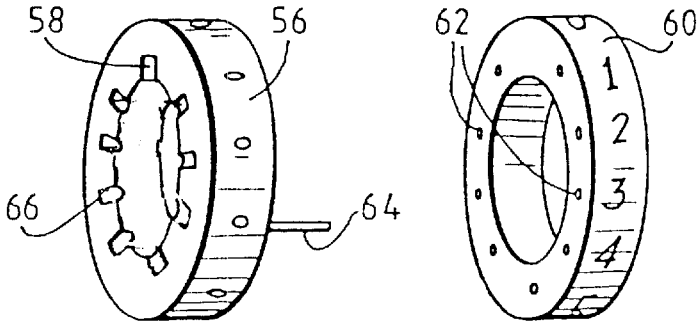
FIG. 5 is an exploded diagram of one of the annuli in the assembly of FIG. 4.
Figure 6:
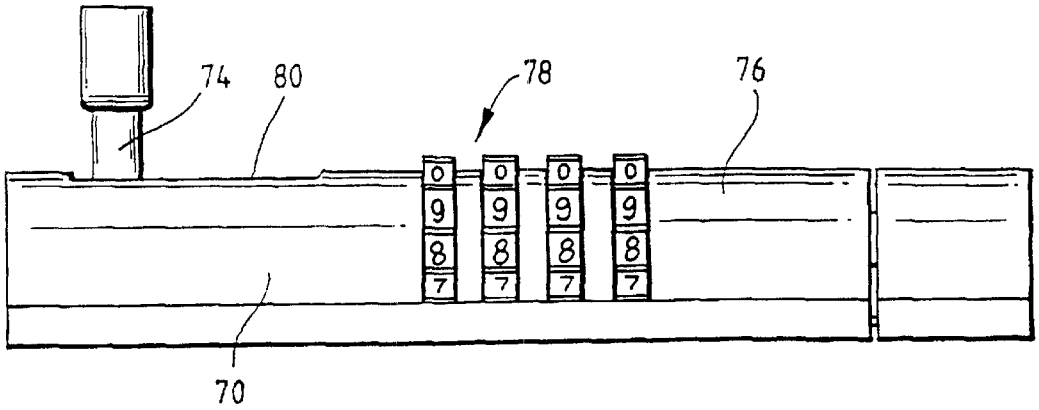
FIG. 6 is a side elevation of a draw bolt assembly according to a third embodiment of the invention.
Figure 7:
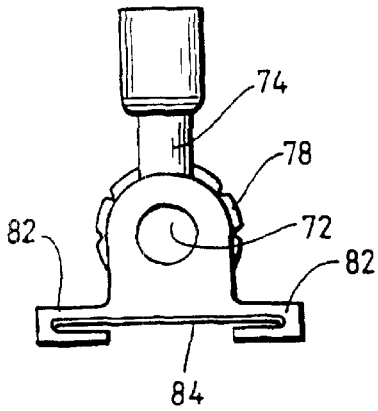
FIG. 7 is an end view from the left as shown of the assembly of FIG. 6.

The draw bolt assembly of FIGS. 4 and 5 operates in essentially the same way as that of FIGS. 1 to 3. A bolt 46 with removable handle 48 is slidable in a housing 50 to selectively engage the receiving bracket 52. Axial movement is only permitted when the four slotted annuli 54 are aligned with complementary spigots on the bolt 46. Rotation of the bolt is restricted by the housing 50 adjacent the handle 48. In this embodiment, each annulus comprises a body 56 formed with the internal slot 58 and an element 60 bearing a plurality of symbols selectively connected or coupled thereto. The element 60 has ten sockets 62 equally spaced on the line of a circle on one axial annular face, and the body 56 has a pair of pins 64 extending from locations on the line of a similar circle on the juxtaposed face. When the body 56 and element 60 are coupled together, the juxtaposed faces are brought into abutting engagement with the pins 64 received in two of the sockets 62 to set their relative angular orientation. In the embodiment shown the arrangement of pins and sockets provides for ten permitted orientations, and these are identified by the numbers "0" to "9" depicted on the outer cylindrical surface of the element 60. Each orientation identifies a unique position of the slot 58.

In the bolt assembly shown the annuli 54 are held in place by the bolt 46. By removing the handle 48 and with the slots and spigots aligned, the bolt can be withdrawn to the left as shown. This releases the annuli 54, which can then be removed downwards as shown, through an opening in the base of the housing 50. The body 56 and element 60 of each annulus can then be disconnected and re-coupled, as described above, to identify the orientation of each slot with a particular digit. The annuli are then returned to the housing. The four selected digits are then aligned to enable passage through the annuli of the bolt 46, which is then returned, and retained in the housing by the handle 48. Random rotation of the annuli then locks the bolt in a locked or unlocked position. Thereafter, movement of the bolt between these positions is only possible when the four selected digits are aligned.

The body 56 in the embodiment of FIGS. 4 and 5 is formed with recesses 66 spaced around one or both of its exposed axial faces to form "blind" slots. These will prevent an attempt to identify the "release" sequence by manoeuvring the bolt to sense the location of a slot 58 in juxtaposition with a spigot.

The body 56 is also formed with dimples on its outer cylindrical surface, aligned with the numbers on the element 60. Units fitted within the housing 50 are biased against the surface to register with a dimple in selected rotational positions of the respective annulus. In this way a ratchet mechanism is provided defining the selected rotational positions, in one of which the slot 58 will be aligned with the line of spigots.

The embodiment of the invention shown in FIGS. 6 to 10 provides for re-coding of the assembly in situ; i.e. without the need for the assembly to be dismantled. The assembly comprises a housing 70 with a bolt 72 with a handle 74 attached thereto. The bolt 72 is movable between its normally unlocked position illustrated in FIG. 6, to the right as shown into a locked position in which the bolt extends into a receiving bracket 76. The re-codable annuli are indicated at 78, and are described in more detail below. The bolt is non-rotatable within the housing. The handle 74 extends through a slot 80 in the housing of width equal to the diameter or lateral dimension of the handle 74.

The housing 70 is typically installed by screws (not shown) which clamp lateral flanges 82 against a substrate. As can be seen from FIG. 7, each flange 82 is slotted to receive a closure plate 84. The closure plate 84 provides for access to the interior of the housing during manufacture of the assembly.

Figure 8:
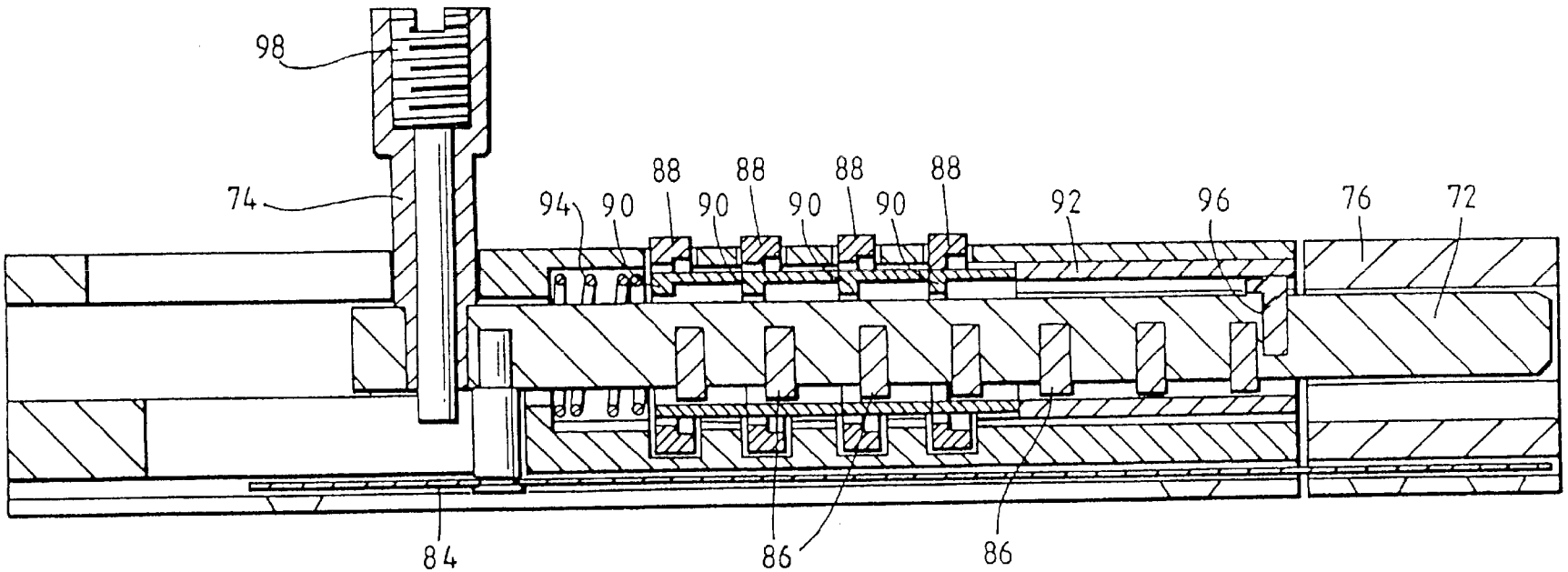
FIG. 8 is a longitudinal cross-section through the bolt assembly of FIG. 6 with the bolt in its "locked" position.
Figure 9:
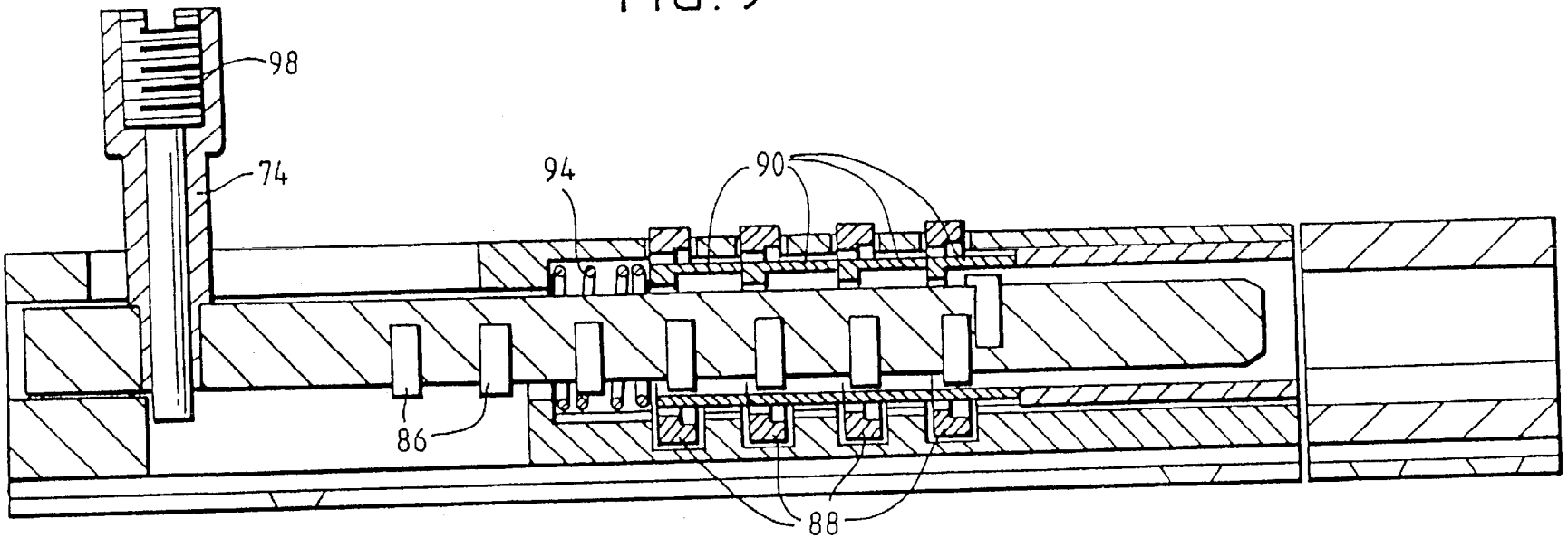
FIG. 9 is a longitudinal cross-section through the bolt of FIG. 6 with the bolt in its "unlocked" position.

FIG. 8 shows the draw bolt assembly in its normal locked position. As can be seen, the bolt has seven spigots 86 extending downwardly therefrom, with a portion of four of them extending within the axial length of a symbol-bearing element 88 of an annulus 78. Leftward movement of the bolt as shown, towards its unlocked position, is prevented by at least one of the slotted bodies 90 of the annuli 78 by virtue of a respective slot being misaligned with the respective spigot 86.

The slotted bodies 90 are axially abutting, and engage a sleeve 92 which defines the passageway in the housing through which the bolt 72 can move. The bodies 90 are urged against the sleeve 92 by a spring 94.

Figure 10:
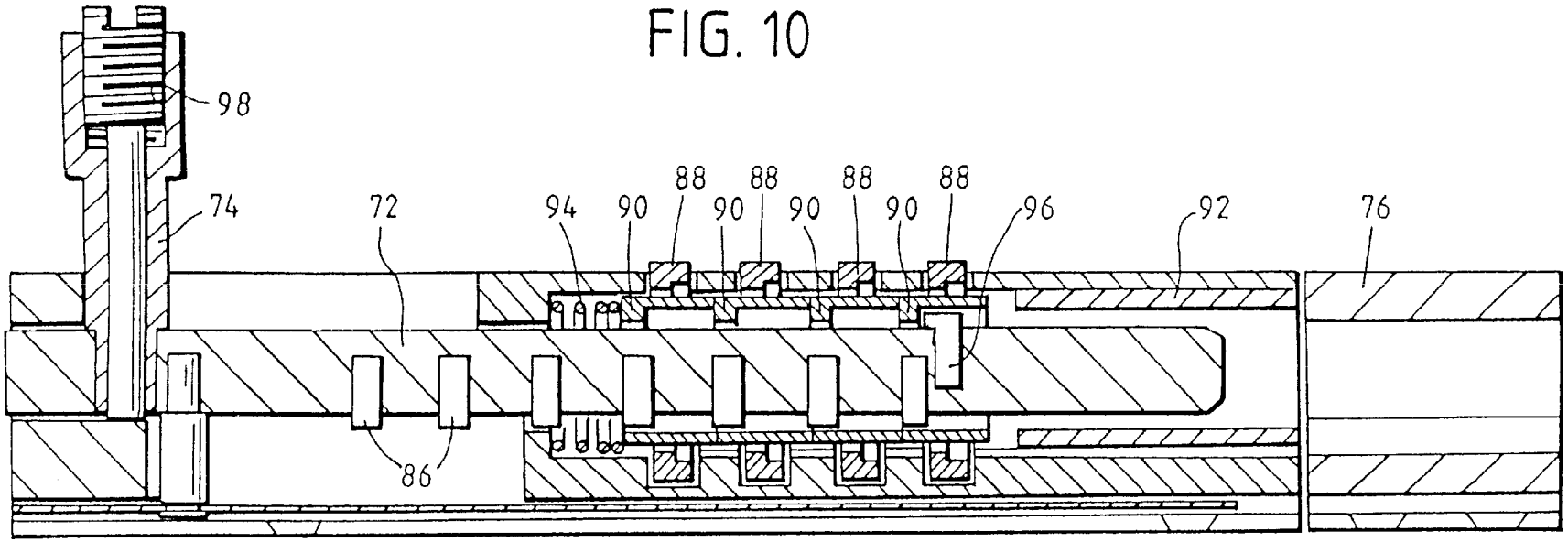
FIG. 10 is a longitudinal cross-section through the bolt assembly of FIG. 6 with the bolt drawn beyond its normal "unlocked" position for re-coding of the assembly.

With the bolt in its locked position, the slotted body and symbol-bearing element of each annulus are coupled, and free to rotate around the shaft of the bolt. When they are rotated into orientations at which the selected sequence of digits or symbols is aligned, so are the respective slots with the spigots 86, enabling the bolt to be withdrawn to its unlocked position shown in FIG. 9. This embodiment of the invention is designed such that in the open position shown in FIG. 9 there are four spigots 86 actually located in the slots of the bodies 90, with the consequence that the symbol-bearing elements 88 cannot now rotate. They can be released to rotate only by disengagement with the slotted bodies 90. This is made possible by further movement of the bolt 72 to the left as shown beyond its "unlocked" position, to that shown in FIG. 10. Such further movement is normally prevented by a screw 98, which extends through the bolt 72 to form a stop against a shoulder 100 in the housing. Withdrawal of the screw 98, as shown in FIG. 10, allows bolt 72 to be withdrawn further until the handle 74 engages the end 102 of the slot 80. This further movement draws the spigots 86 and the key 96, which in turn draws the slotted bodies 90 against the spring 94 out of engagement with the symbol-bearing elements 88. With the symbol-bearing elements 88 being so disengaged, they are once again free to rotate, and a new sequence of symbols or numbers can be selected at which the slots and spigots are aligned. When the new sequence has been chosen, the bolt 72, or handle 74, can be released and the slotted bolt bodies 90 will move to the right, as shown in FIG. 10, under the force of the spring 94 to re-engage with the elements 88.

In order to achieve positive engagement between the slotted bodies 90 and their respective elements 88, one is formed with a pin which extends axially to be received in sockets formed in the other. When the parts are disengaged, the pins are withdrawn from the socket and after re-orientation of the symbol-bearing elements, the pins are received in a different set of sockets, broadly as described above with reference to FIG. 5. It will be appreciated, though, that other engagement mechanisms, or variations of this mechanism, may be used.

The bolt arrangement may also be used as a lockable latch as shown in FIG. 11. As shown, a latch member 100 is mounted on the end of the bolt 72. The latch member 100 includes a recess 102 which receives the end of the bolt 72. A spring 101 is provided between the bolt 72 and the end face of the recess 102 to resiliently bias the latch member 100 away from the bolt 72.

When the bolt 72 is in the unlocked condition, the latch member 100 can be moved into the housing against the bias of the spring 101. For example, where the latch is provided on a door, the latch member 100 may be moved into the housing by a strike plate on a door jamb, and will then be moved by the bias force out of the housing and into a recess on the door jamb to latch the door closed. In its unlocked condition, the bolt 72 can be moved towards the left as shown in FIG. 11*a*, for example by a handle, to retract the latch member 100, and thereby release the door. When the bolt 72 is locked, no movement of the bolt 72 and hence no movement of the latch 100 is possible.

The invention has been described in detail herein by way of example only, and many variations are possible without departing from the spirit and scope of the invention. Particularly, it should be appreciated that features described with reference to one embodiment may be used in others.

What is claimed is:

1. A draw bolt assembly comprising a housing having an axial passageway formed therein; a bolt slidably mounted in the passageway for movement along the axis thereof, said bolt having at least one spigot extending radially from the bolt; a plurality of annuli aligned along the axis in the passageway, each annulus having an internal slot of a size for receiving passage of the spigot and the plurality of annuli being restrained by the housing; and a resilient means; whereby rotation of the annuli to axially align the slots with the spigot allows movement of the bolt along the passageway, and wherein each annulus comprises a body formed with the internal slot and an associated element bearing a plurality of symbols, at least one of which to be visible on an external surface thereof, to indicate the position of the slot in the associated annulus, the relative orientation of the body and its associated element being adjustable to change the alignment of the slot relative to the symbols, and wherein the slotted bodies of the annuli are coupled for simultaneous axial movement against the resilient means relative the symbol-bearing elements to disengage the bodies from their respective elements for re-orientation, and further comprising a re-coding key mounted on the bolt and adapted to engage an end one of the bodies at one of the normal locked and unlocked positions of the bolt when the slotted bodies are aligned, the bolt being selectively movable beyond its normal said one position to effect movement of the coupled bodies from their respective elements.

2. A draw bolt assembly according to claim 1 wherein each body and associated element are annuli in axially abutting engagement, and wherein each annulus comprises a locking mechanism setting the relative angular orientation of a body with its associated element.

3. A draw bolt assembly according to claim 2 wherein the locking mechanism comprises pins extending axially from one of the body and element, and received in at least two of a greater plurality of sockets formed in the other of the body and element.

4. A draw bolt assembly according to claim 1 wherein the body is formed with recesses spaced around at least one of its axial faces to form blind slots.

5. A draw bolt assembly according to claim 1 including a ratchet mechanism for biasing the annuli into selected rotational positions.

6. A draw bolt assembly according to claim 5 wherein each annulus is formed with a number of dimples in a circular path on an external surface equal to the number of symbols, the ratchet mechanism comprising a unit biased against the annulus at a point on said circular path such that the unit engages a dimple in each of its selected rotational positions.

7. A draw bolt assembly according to claim 1 further comprising means for attaching the housing to a surface.

8. A draw bolt assembly according to claim 7 wherein the annuli substantially cover the attachment means.

9. A draw bolt assembly according to claim 1 wherein the bolt has a plurality of said spigots.

10. A draw bolt assembly according to claim 9 wherein the number of annuli is equal to the number of spigots on the bolt.

11. A draw bolt assembly according to claim 9 wherein the bolt has four spigots.

12. A draw bolt assembly according to claim 1 wherein each body and element of each annulus are re-orientable without dismantling the assembly.

13. A draw bolt assembly according to claim 1 wherein the bolt is selectively movable when the slots of the annuli are aligned with said at least one spigot.

14. A draw bolt assembly according to claim 13 including a stop mechanism for normally preventing such selective movement.

15. A draw bolt assembly according to claim 1 wherein the bolt is non-rotatable in the passageway and has a handle attached thereto extending through a slot in the housing.

16. A draw bolt assembly according to claim 13 including a stop mechanism for normally preventing such selective movement, and wherein the stop mechanism comprises a screw in the handle.

17. A lockable latch comprising a draw bolt assembly according to claim 1 and a latch member connected to the end of the bolt and resiliently biased away from the bolt.

* * * * *